US010176732B1

(12) United States Patent
Hinkens

(10) Patent No.: US 10,176,732 B1
(45) Date of Patent: Jan. 8, 2019

(54) DISPLAY CARD HOLDER

(71) Applicant: GBH Products LLC, Mequon, WI (US)

(72) Inventor: George Hinkens, Mequon, WI (US)

(73) Assignee: GBH Products LLC, Mequon, WI (US)

( * ) Notice: Subject to any disclaimer, the term of this patent is extended or adjusted under 35 U.S.C. 154(b) by 45 days.

(21) Appl. No.: 15/644,699

(22) Filed: Jul. 7, 2017

(51) Int. Cl.

| | |
|---|---|
| ***G09F 15/00*** | (2006.01) |
| ***G09F 7/18*** | (2006.01) |
| ***G09F 21/04*** | (2006.01) |
| ***G09F 7/08*** | (2006.01) |

(52) U.S. Cl.
CPC ..... *G09F 7/18* (2013.01); *G09F 7/08* (2013.01); *G09F 21/04* (2013.01); *G09F 2007/1847* (2013.01); *G09F 2007/1865* (2013.01)

(58) Field of Classification Search
CPC .... G09F 1/03; A63B 2069/3602; B42F 13/16; B42F 13/20
USPC ..... 40/607.14, 658, 647, 648; 248/316.3, 248/316.7; 281/50
See application file for complete search history.

(56) References Cited

U.S. PATENT DOCUMENTS

| | | | |
|---|---|---|---|
| 3,025,093 | A | 3/1962 | Millman |
| 3,514,820 | A | 6/1970 | Rogg |
| 3,665,629 | A | 5/1972 | Shore |
| 3,909,888 | A | 10/1975 | Funston et al. |
| 3,958,788 | A | 5/1976 | Feibelman |
| 4,089,116 | A | 5/1978 | Bearinger |
| 4,449,310 | A | 5/1984 | Kline |
| 4,498,827 | A | 2/1985 | Mair |
| 4,645,105 | A | 2/1987 | Plumbridge |
| 4,699,303 | A | 10/1987 | Kline |
| D295,919 | S | 5/1988 | Makio |
| 5,020,196 | A | 6/1991 | Panach et al. |
| 5,022,689 | A | 6/1991 | Perdue, Jr. et al. |
| 5,134,757 | A | 8/1992 | Johnson |
| 5,184,375 | A | 2/1993 | Hoyt |
| 5,489,121 | A | 2/1996 | Mohr |
| 5,676,400 | A | 10/1997 | Lin |
| 5,697,176 | A | 12/1997 | Kuni, Jr. et al. |
| 5,996,264 | A | 12/1999 | Nagel |

(Continued)

FOREIGN PATENT DOCUMENTS

| | | |
|---|---|---|
| JP | 2000356948 | 12/2000 |
| WO | WO 89/10605 | 11/1989 |

*Primary Examiner* — Joanne Silbermann
(74) *Attorney, Agent, or Firm* — Michael Best & Friedrich LLP

(57) ABSTRACT

A display card holder including a sleeve for a printed card and a sleeve holder defining a cavity open at one end to receive a sleeve end section having a pair of cutouts. The cavity defines a sleeve-receiving channel having a width providing clearance to the sleeve thickness. A button member movably supported by a sleeve holder body defines an actuator portion exposed to an outside of the sleeve holder. The button member includes wings extending from opposite sides of the actuator button. A spring biases the button member in a first direction with respect to the body of the sleeve holder. Each wing is formed to include: a pin adapted to extend through a corresponding one of the cutouts, and an elongate first edge forming a pivot about which the button member is pivotable with respect to the sleeve holder body.

20 Claims, 13 Drawing Sheets

(56) References Cited

U.S. PATENT DOCUMENTS

| | | | | |
|---|---|---|---|---|
| 6,003,259 | A | 12/1999 | Krapf et al. | |
| 6,182,938 | B1 * | 2/2001 | Wright | A47G 1/21 211/45 |
| 6,336,765 | B1 | 1/2002 | Watanabe | |
| 6,357,090 | B1 | 3/2002 | Murai | |
| 6,484,429 | B1 | 11/2002 | Przylucki | |
| 6,658,777 | B2 | 12/2003 | Dundorf | |
| 6,678,977 | B1 | 1/2004 | Sherman | |
| 6,688,027 | B2 | 2/2004 | Fink | |
| 7,103,997 | B2 | 9/2006 | Ruffino | |
| 7,121,030 | B2 | 10/2006 | Schneider | |
| 7,159,347 | B1 | 1/2007 | Ngan | |
| 7,207,129 | B2 | 4/2007 | Buchanan et al. | |
| D554,561 | S | 11/2007 | DiCarlo | |
| 7,293,382 | B2 | 11/2007 | Polvere et al. | |
| 7,487,611 | B2 | 2/2009 | Robb | |
| 7,743,541 | B2 | 6/2010 | Suciu et al. | |
| 7,823,311 | B2 | 11/2010 | Pitcher et al. | |
| 9,015,973 | B2 | 4/2015 | Pasternak et al. | |
| 2002/0035798 | A1 | 3/2002 | Gray | |
| 2004/0128895 | A1 | 7/2004 | Trudel | |
| 2004/0154204 | A1 | 8/2004 | Fu | |
| 2004/0163295 | A1 * | 8/2004 | Fontana | A47B 97/02 40/617 |
| 2007/0144048 | A1 | 6/2007 | Kodde et al. | |
| 2008/0202007 | A1 * | 8/2008 | Suciu | G09F 3/20 40/658 |
| 2012/0211534 | A1 | 8/2012 | Hake | |

* cited by examiner

DISPLAY CARD HOLDER

BACKGROUND

The present invention relates to devices for removably holding a disposable card, such as an information card or score card. Such devices can be provided in multiple detachable parts. In some uses, such devices can be susceptible to vibration, and particularly disturbing rattling noise, when fully assembled.

SUMMARY

In one aspect, the invention provides a display card holder including a sleeve, a sleeve holder, a button member, and a spring. The sleeve defines a receptacle for a printed card, and includes an end section defining a thickness and having a pair of cutouts. The sleeve holder defines a cavity open at one end to receive the end section of the sleeve, and the cavity defines a sleeve-receiving channel having a width providing clearance to the thickness of the sleeve. The button member is movably supported by a body of the sleeve holder, and the button member defines an actuator portion that is exposed to an outside of the sleeve holder. The button member further includes a pair of wings extending from opposite sides of the actuator button. The spring is arranged to bias the button member in a first direction with respect to the body of the sleeve holder. Each of the pair of wings is formed to include: a pin adapted to extend through a corresponding one of the pair of cutouts, and an elongate first edge forming a pivot about which the button member is pivotable with respect to the body of the sleeve holder.

In another aspect, the invention provides a display card holder. A sleeve of the display card holder defines a receptacle for a printed card, and the sleeve includes an end section defining a thickness and having at least one cutout. A sleeve holder of the display card holder defines a cavity open at one end to receive the end section of the sleeve. The cavity defines a sleeve-receiving channel having a width providing clearance to the thickness of the sleeve. A button member is movably supported by a body of the sleeve holder and defines an actuator portion. The button member is pivotably supported in a cradle of the sleeve holder and adapted to latch into the at least one cutout of the sleeve end section. A spring is arranged to bias the button member in a first direction with respect to the body of the sleeve holder so that the end section of the sleeve is pinched by the button member against an interior surface of the cavity when fully inserted into the sleeve-receiving channel. The sleeve holder includes a cap member secured at an end of the sleeve holder opposite the open end to enclose the button member and form an arcuate guide surface establishing a sliding interface with the button member.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
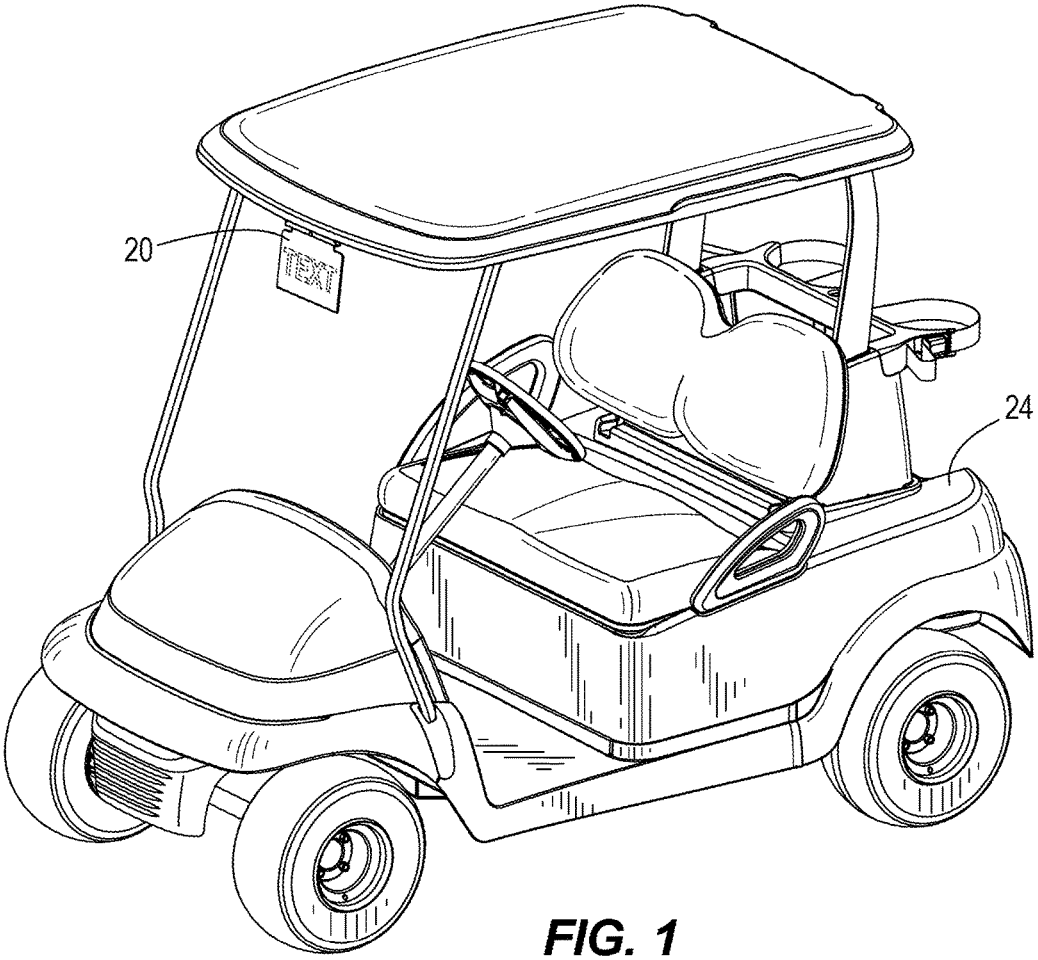
FIG. 1 is a perspective view of a display card holder according to an embodiment of the present invention, affixed to a golf cart.
Figure 2:
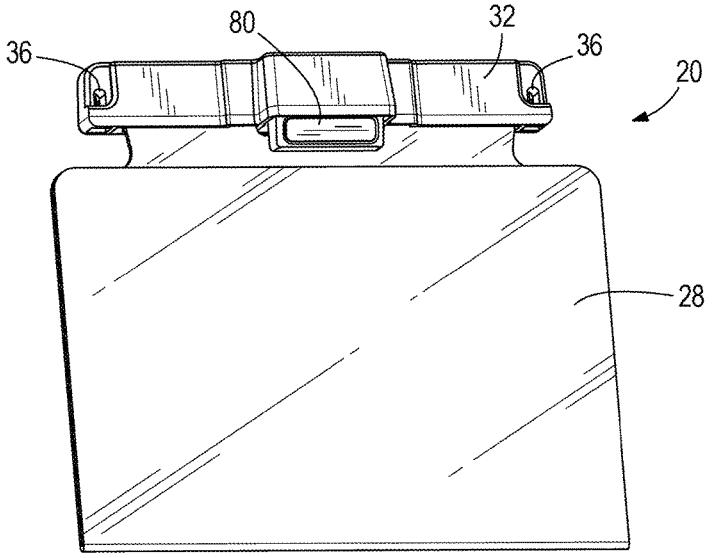
FIG. 2 is a perspective view of the display card holder of FIG. 1.

FIGS. 1-16 illustrate a display card holder 20 according to one embodiment of the invention. As shown in FIG. 1, the display card holder 20 can be used to retain and display a display card C (FIG. 3) having indicia (e.g., text or pictorial). The display card holder 20 is adapted to enable attachment to a support surface such as, for example, a surface of the golf cart 24 of FIG. 1. The display card holder 20 includes two main components that are separable and releasably latchable together. The first of these components is a sleeve 28 having a receptacle such as a slot formed between two overlying panels. One or both panels can be transparent or translucent to allow viewing of the display card C therein. The other main component of the display card holder 20 is a sleeve holder 32 adapted to receive a portion of the sleeve 28 and to releasably latch onto the sleeve 28. The sleeve holder 32 can be secured to a support surface, for example secured with fasteners that extend through apertures 36 of the sleeve holder 32 (FIG. 2), to remain in place while the sleeve 28 that receives the display card C can be attached to and released from the sleeve holder 32. The sleeve 28 may be frequently removed from the sleeve holder 32, and the display card holder 20 may be provided on each one of a fleet of golf carts 24 or other support surfaces. Thus, the ease of attaching and detaching the sleeve 28 and the sleeve holder 32 is of high importance. Further, because the golf cart 24 (or other movable object) moves about while the sleeve 28 is mounted to the sleeve holder 32, the sleeve 28 should be designed to avoid rattling, vibration, and certainly inadvertent detachment.

Figure 3:
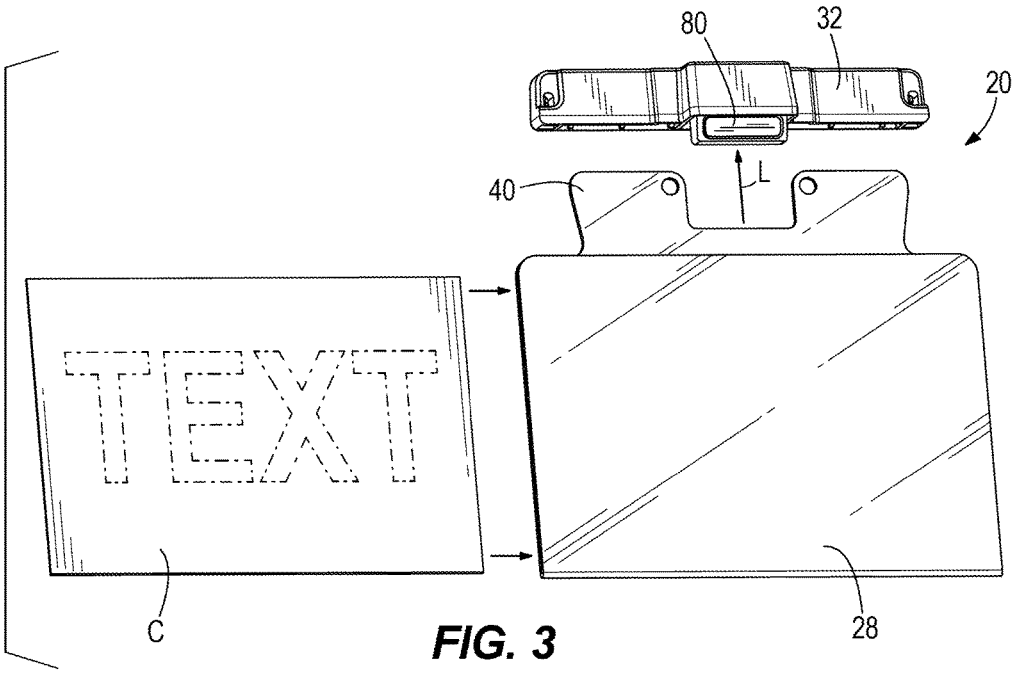
FIG. 3 is a perspective view of the display card holder of FIGS. 1 and 2 in a detached state and with a disposable card removed.
Figure 4:
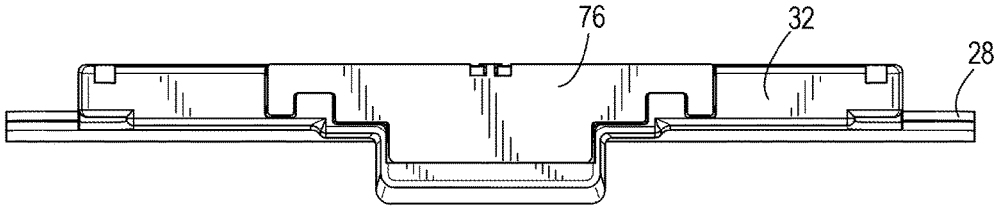
FIG. 4 is a top view of the display card holder.
Figure 5:
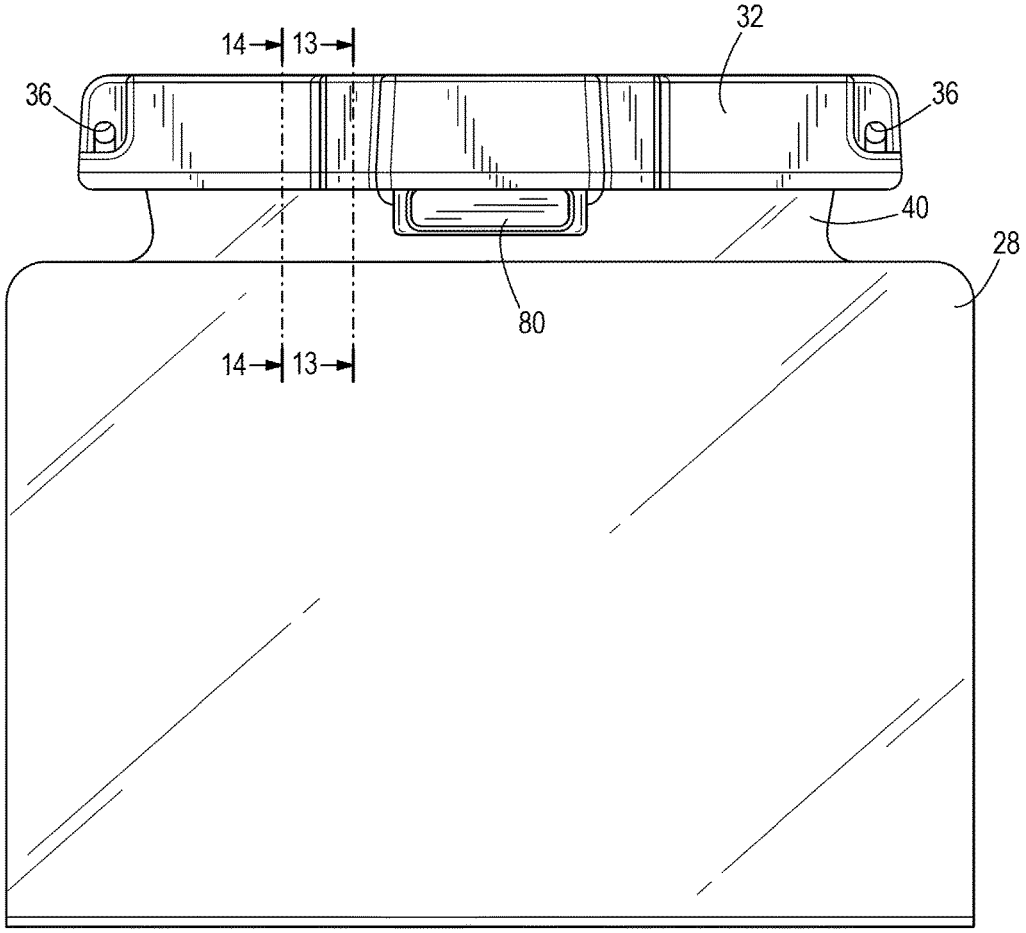
FIG. 5 is a front view of the display card holder.
Figure 6:
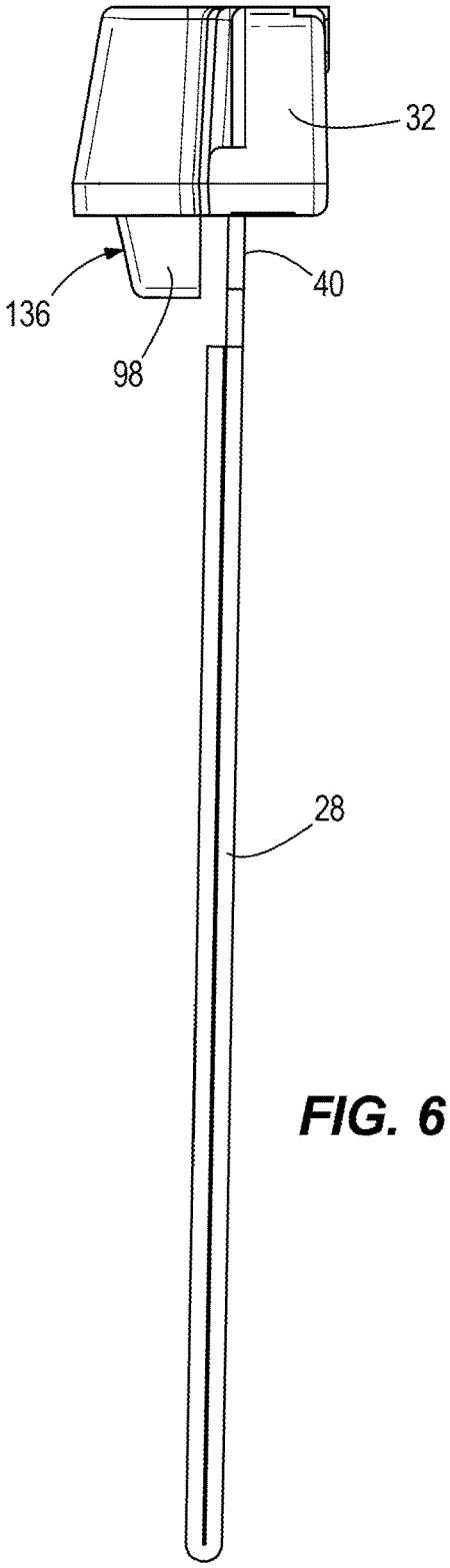
FIG. 6 is a right side elevation view of the display card holder.
Figure 7:
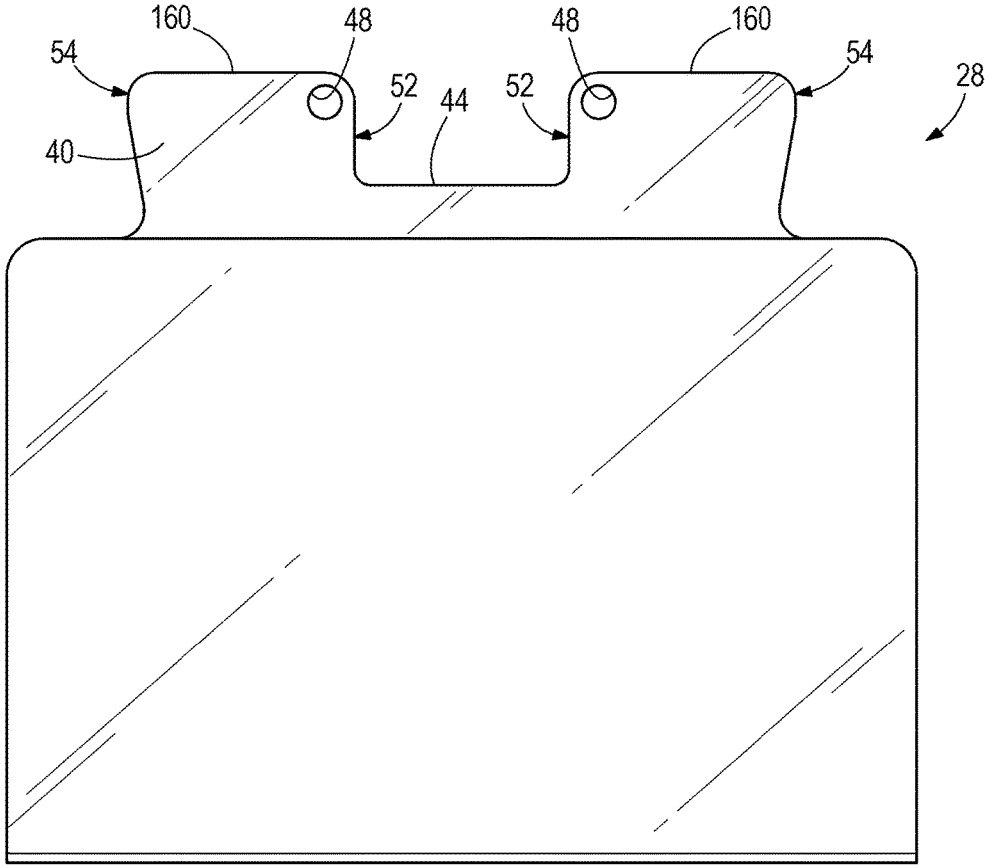
FIG. 7 is a front view of a card retaining sleeve of the display card holder.
Figure 8:
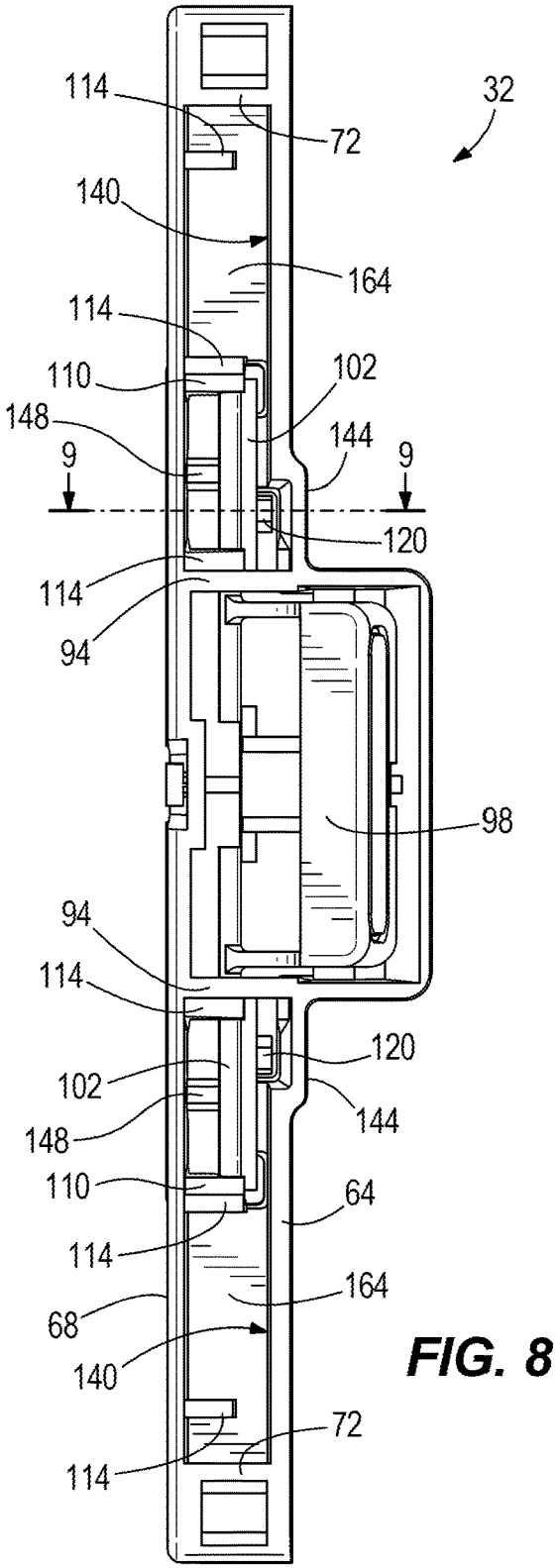
FIG. 8 is a bottom view of a sleeve holder of the display card holder.
Figure 9:
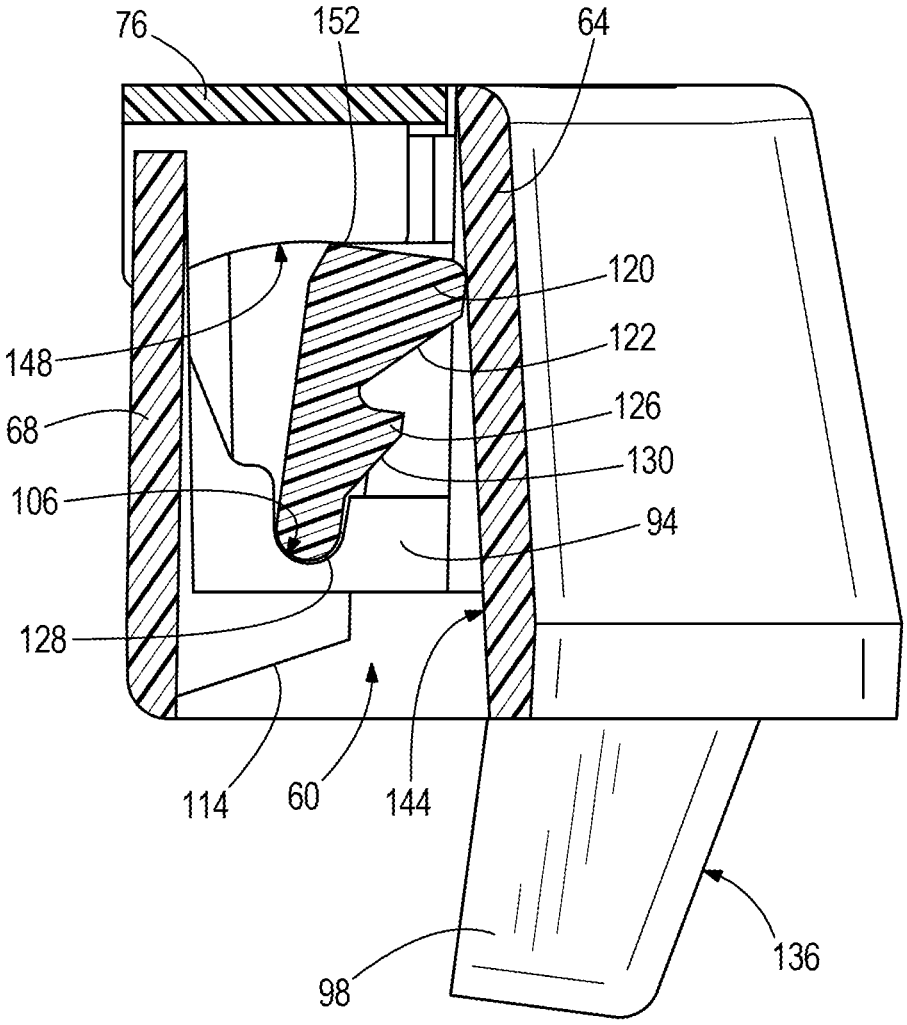
FIG. 9 is a cross-section view of the sleeve holder, taken along line 9-9 of FIG. 8.

With reference to FIGS. 3 and 7, the sleeve 28 includes an end section 40 at one end of the sleeve 28, at least part of which is insertable into the sleeve holder 32. The end section 40 can be a section of the sleeve 28 formed by multiple panels, or by a single panel in some constructions as shown in the drawings. The end section 40 can include a first cutout 44 and at least one additional cutout 48, such as a pair of cutouts 48 on opposite sides of the first cutout 44 as shown. The first cutout 44 can be an open-ended cutout or recess formed by the contour of a perimeter edge of the end section 40. The additional cutouts 48, which are used for latching as described further below, can be holes or apertures set inwardly from the perimeter edge of the end section 40. Alternately, the additional cutout(s) 48 can be formed as an extension of the first cutout 44. The cutouts 44, 48 can extend fully or partially through a thickness T defined by the end section 40. The first cutout 44 defines a first or internal pair of lateral guide surfaces 52 that constrain insertion of the sleeve 28 into a predefined widthwise position within the sleeve holder 32 (left-right direction, positioned as shown in FIG. 5) when the sleeve 28 is inserted in a lengthwise direction (arrow L in FIG. 3). Opposite outside edges of the end section 40 further define a second or external pair of lateral guide surfaces 54 that constrain insertion of the sleeve 28 into the predefined widthwise position within the sleeve holder 32.

Figure 10:
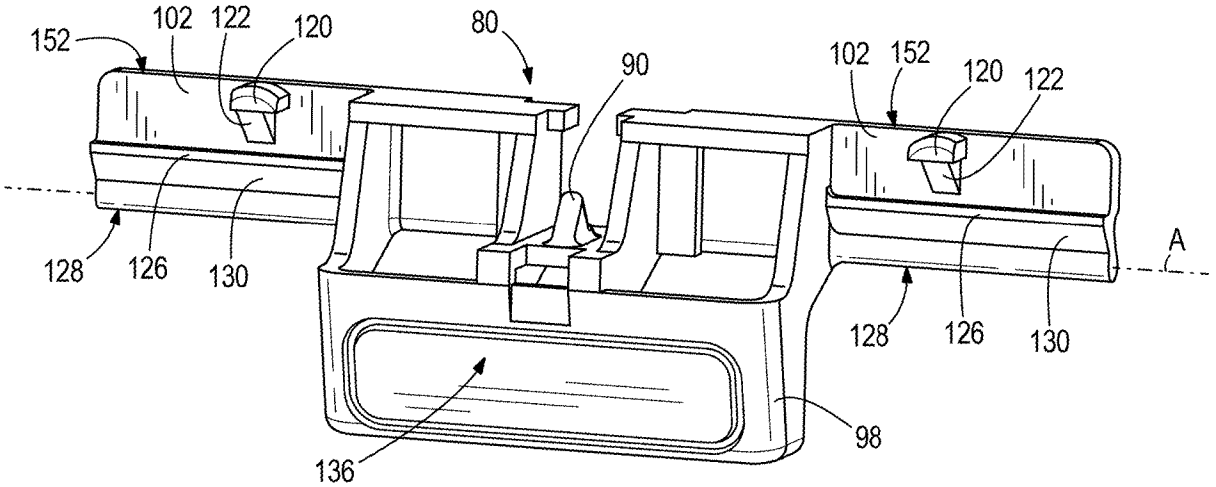
FIG. 10 is a perspective view of a button member of the sleeve holder.
Figure 11:
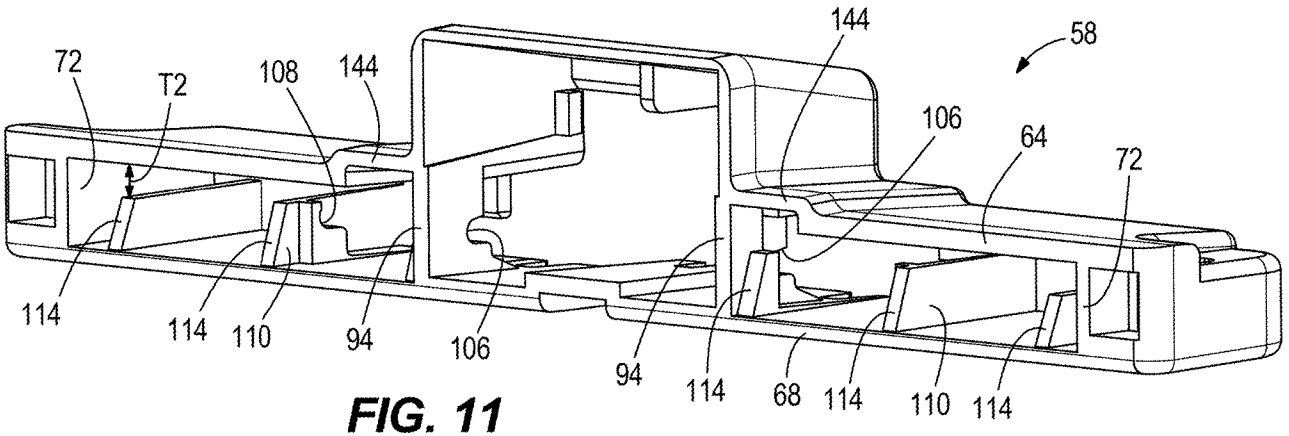
FIG. 11 is a perspective view of a body of the sleeve holder.
Figure 12:
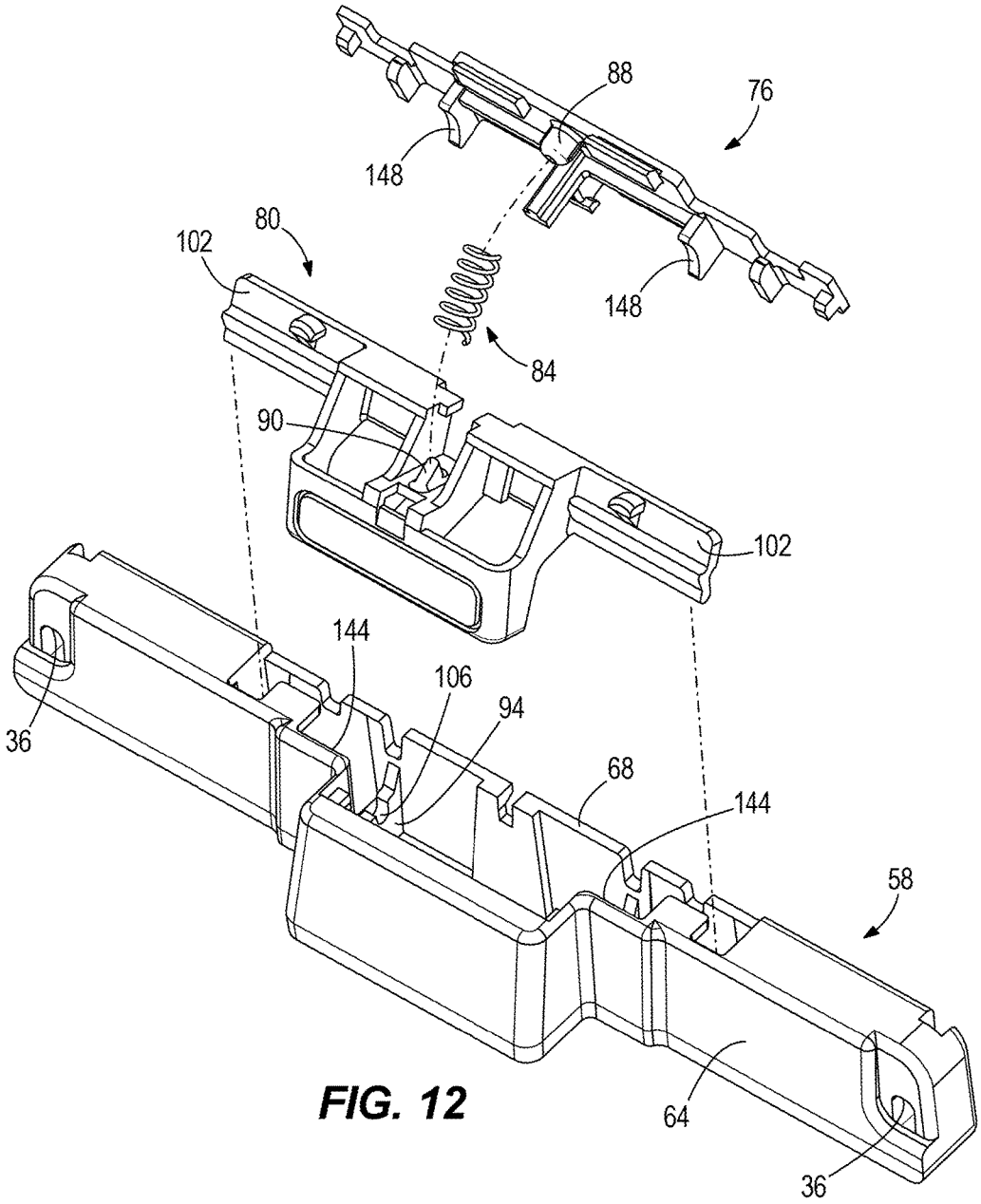
FIG. 12 is an exploded assembly view of the sleeve holder.

As shown throughout FIGS. 2-6, 8, 9, 11 and 12-16, the sleeve holder 32 is a sleeve holder assembly assembled from several components including a sleeve holder body 58 that defines a cavity 60 that is open at one end, for example, a bottom end. The cavity 60 is bounded by a front wall 64, a rear wall 68 spaced from the front wall 64 and substantially parallel thereto, two end walls 72 extending between the front and rear walls 64, 68, and a top wall at least partially provided by a cap member 76. By substantially parallel, it is meant that an angle between the front and rear walls 64, 68 is 0 degrees (i.e., parallel)+/−10 degrees. The top wall formed at least partially by the cap member 76 may be substantially perpendicular to the front and rear walls 64, 68, i.e., oriented at an angle of 90 degrees (i.e., perpendicular)+/−10 degrees. The two end walls 72 guide and generally constrain the external lateral guide surfaces 54 of the end section 40 of the sleeve 28. A latching mechanism is provided by a button member 80 that is movably supported within the sleeve holder body 58 and biased in a first direction (e.g., clockwise in FIG. 9) by a spring 84 shown in FIG. 12. The spring 84 can be compressed between an interior surface of the cap member 76 and a portion of the button member 80. The cap member 76 and the button member 80 can have respective spring mounts provided by respective projections 88, 90 as shown in FIGS. 10 and 12.

A plurality of cross-bars 94 extend between the front and rear walls 64, 68 and subdivide the cavity 60. For example, as shown in FIG. 11, a pair of cross-bars 94 subdivide the cavity 60 into three parts including a central part for accommodating an actuator portion 98 of the button member 80 (FIG. 10), and a pair of additional parts on opposite sides of the central part for accommodating portions of the end section 40 of the sleeve 28 along with lateral flanks or wings 102 (FIG. 10) of the button member 80 provided to engage the end section 40 of the sleeve 28. Each of the cross-bars 94 is provided as a wall section that guides and generally constrains the position of one of the internal lateral guide surfaces 52 of the end section 40 of the sleeve 28. Further, each cross-bar 94 defines a receptacle or cradle 106 defining an arcuate pocket for receiving a portion of the button member 80, for example one of the wings 102. The cradle 106 and the button member 80 define a pivot having a pivot axis A (FIG. 10) about which the button member 80 is pivotable with respect to the sleeve holder body 58 as further described below. Additional receptacles or cradles 108 are provided by partial walls 110 that extend from the rear wall 68 but not fully to the front wall 64 so that a sleeve-receiving channel is defined therebetween. Angled ramp surfaces 114 can be provided on the bottom ends of the partial walls 110 and also on the cross-bars 94 to aid in guiding the leading edge of the sleeve end section 40 into the sleeve-receiving channel of the holder 32 by tapering gradually toward the front wall 64. Further angled ramp surfaces 114 can be provided at or adjacent to the end walls 72 as shown in FIG. 11. It is noted that the sleeve-receiving channel is subdivided into two parts corresponding to the two parts of the end section 40 that are inserted lengthwise into the sleeve holder 32.

Figure 13:
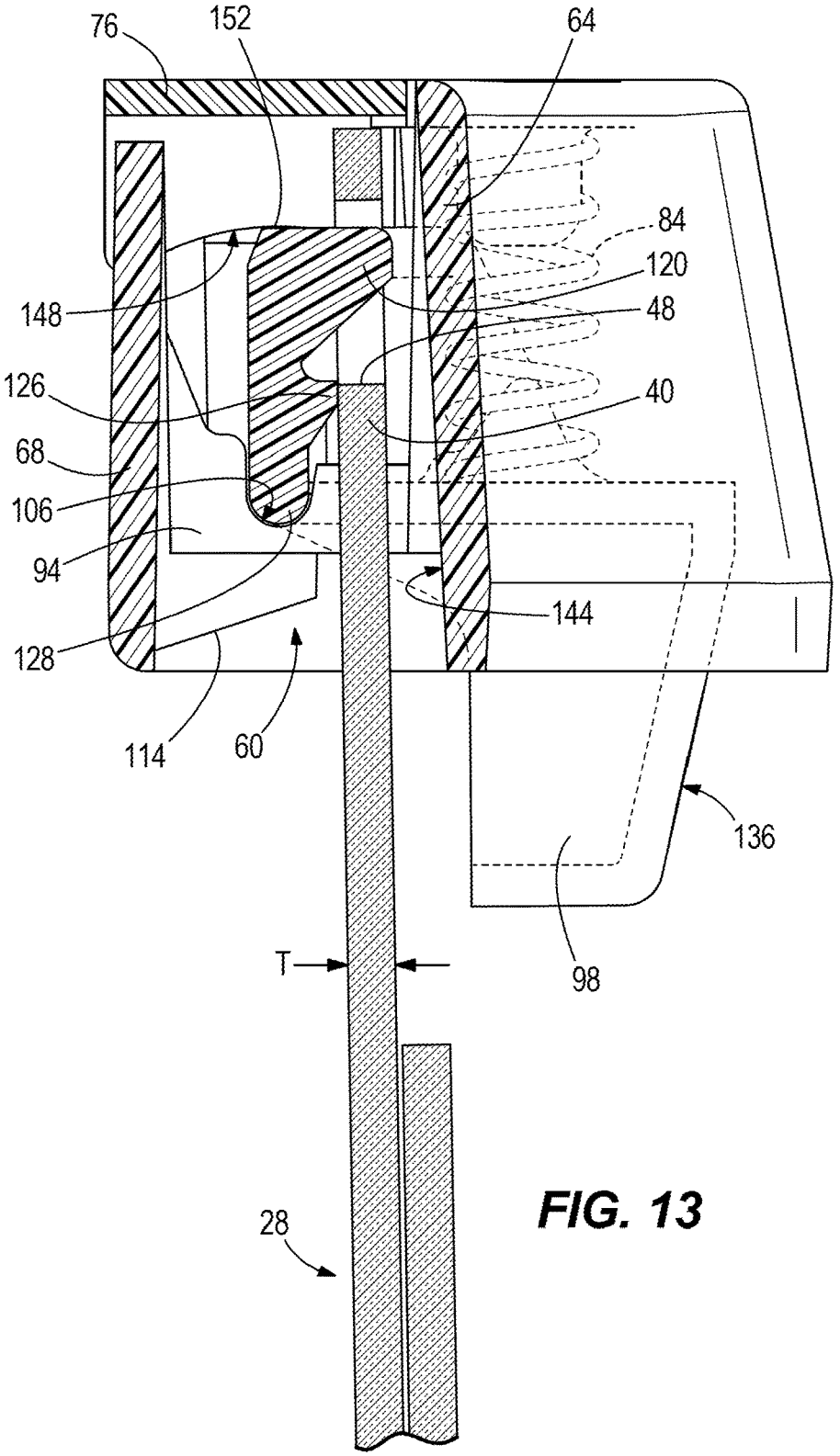
FIG. 13 is a cross-section view of the assembled display card holder, taken along line 13-13 of FIG. 5.

A mentioned briefly above, the button member 80 is adapted to latch the end section 40 of the sleeve 28. However, the button member 80 and particularly the wings 102 are further adapted to both latch and separately pinch or squeeze the end section 40 to minimize or prevent vibration or rattling of the sleeve 28 when fully seated into the sleeve holder 32. Each of the wings 102 is formed to include a pin 120 so that the two pins 120 of the button member 80 correspond to the cutouts 48 of the sleeve 28 and generally have the same widthwise spacing. The pins 120 are sized and shaped to be at least partially received into and optionally extended through the cutouts 48 (i.e., through the thickness T of the sleeve 28 at the end section 40 as shown in FIG. 13). Each pin 120 is formed with a ramped inlet surface 122 on a side facing the open end of the cavity 60. Spaced from the pins 120, each wing 102 defines a raised ridge 126 facing the sleeve-retaining channel for establishing a line of contact with the end section 40 of the sleeve 28 when inserted into the sleeve holder 32. Leading up to each raised ridge 126 from an elongate first or lower edge 128 of the wing 102 is a ramped inlet surface 130. The ramped inlet surfaces 122, 130 assist in moving the button member 80 against the spring 84 to allow latching of the sleeve 28 into the sleeve holder 32 without fully actuating the button member 80 by hand, or without separately actuating the button member 80 at all via the actuator portion 98.

Within the cavity 60 and particularly at the front wall 64 forming one side of the sleeve-receiving channel is a pair of abutment surfaces provided as flat, co-planar surfaces 140. A width T2 (FIGS. 11 and 14) of the sleeve-receiving channel is larger than the sleeve thickness T so that the button member 80 is solely responsible for pinching the sleeve 28 and latching into the cutouts 48. When fully actuated to a retracted or unlatched position (FIG. 16), the button member 80 allows the sleeve 28 to freely drop out of the sleeve holder 32 without any other resistance by the sleeve holder body 58. It is also noted that the actuator portion 98 of the button member 80 extends out from the open end of the sleeve holder body 58, and a front surface 136 of the actuator portion 98 becomes increasingly hidden behind the front wall 64 when the button member 80 is actuated against the bias of the spring 84 (e.g., by a force F of FIG. 16 which acts counter-clockwise about the pivot). When the sleeve 28 is fully seated and latched in the sleeve holder 32, a front surface of the end section 40 is pressed into or pinched against these surfaces 140 by the button member 80 and particularly by the raised ridges 126. At the widthwise location of the pins 120, the front wall 64 is extended further forward to create recesses or pockets 144 that allow the pins 120 to extend across and past the pair of flat, co-planar surfaces 140. As shown in FIG. 15, the abutment of the pins 120 into the pockets 144 can form a limit position of the button member 80 within the holder body 58 when the sleeve 28 is removed.

The cap member 76 is securely attached to the sleeve holder body 58 without separate fasteners. Rather, the cap member 76 is designed with one or more interfaces enabling the cap member 76 to snap into the sleeve holder body 58 following the insertion of the button member 80 and the spring 84 into the cavity 60. A portion of the cap member 76 facing the interior of the sleeve holder 32 is formed with one or more guide surfaces for guiding the button member 80 during actuation relative to the sleeve holder body 58. For example, the cap member 76 of the illustrated construction includes arcuate guide surfaces 148 adjacent to and in sliding relationship with each wing 102 of the button member 80. In particular, a second or upper edge 152 of each wing 102, opposite the first or lower edge 128, is in contact with a corresponding arcuate guide surface 148. The sliding contact can be maintained throughout the pivoting range of the button member 80 between latched and unlatched positions.

Figure 14:
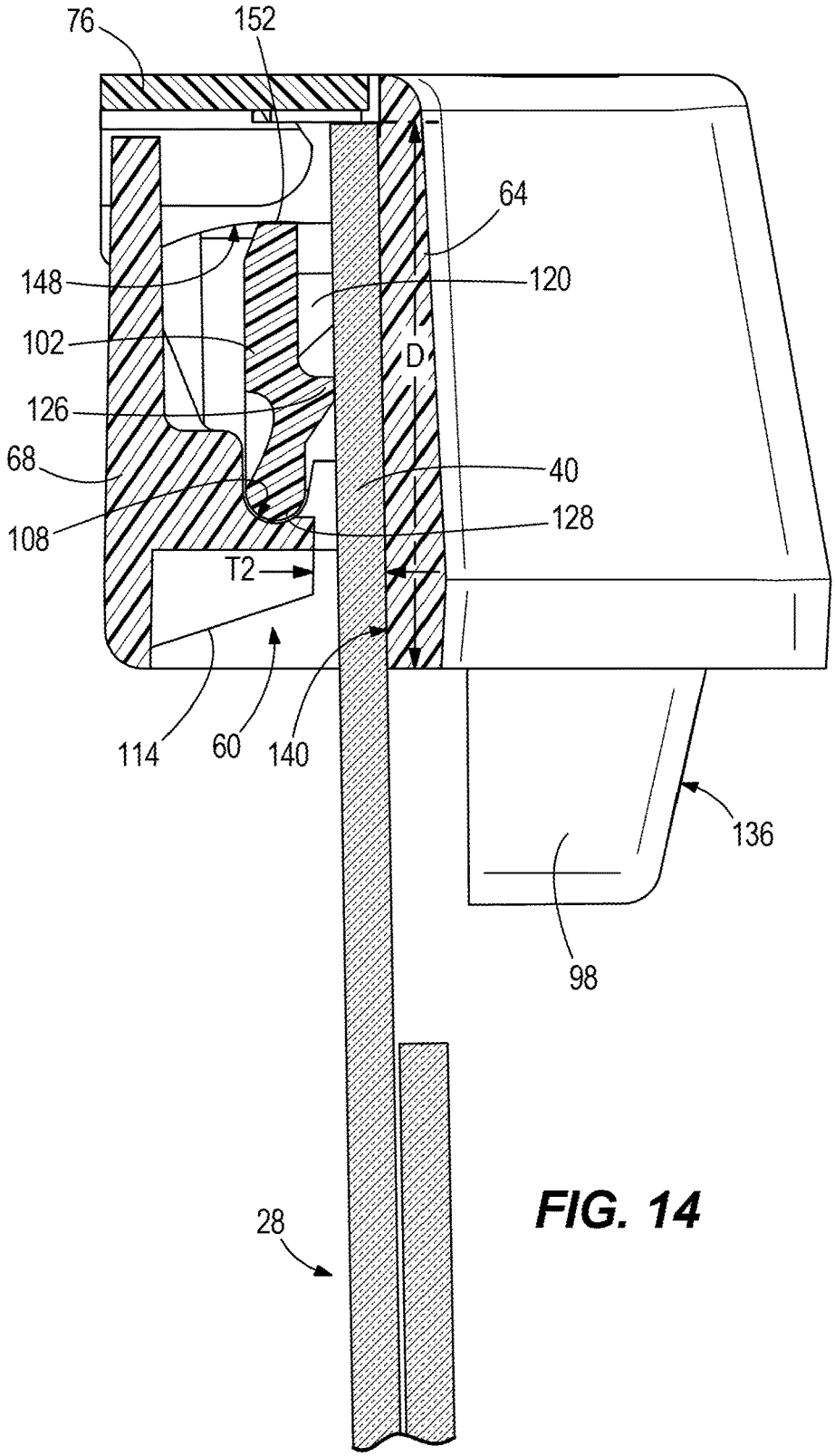
FIG. 14 is a cross-section view of the assembled display card holder, taken along line 14-14 of FIG. 5.
Figure 15:
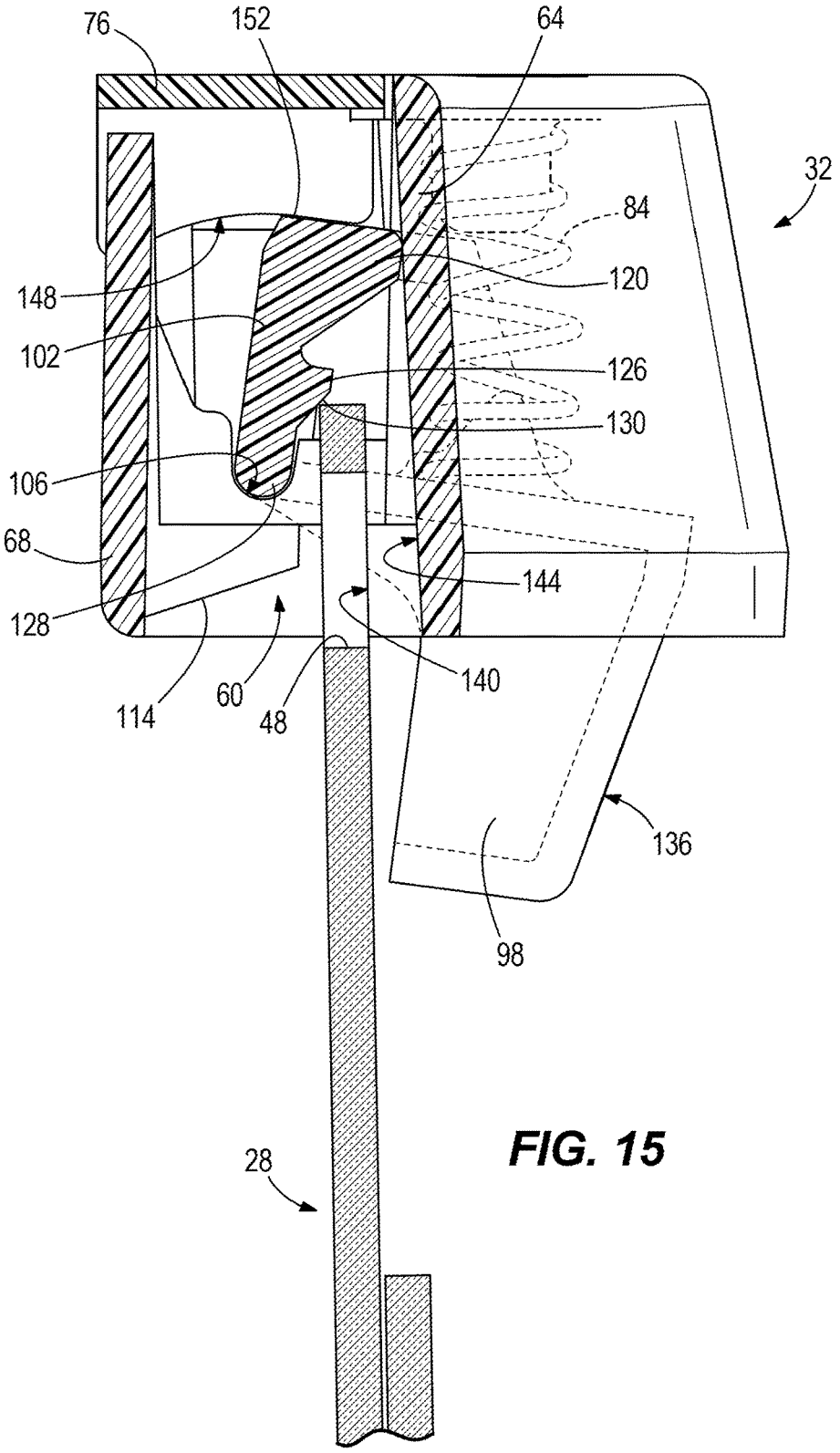
FIG. 15 is a cross-section taken at the same plane as FIG. 13, showing the initial insertion of the sleeve into the sleeve holder.
Figure 16:
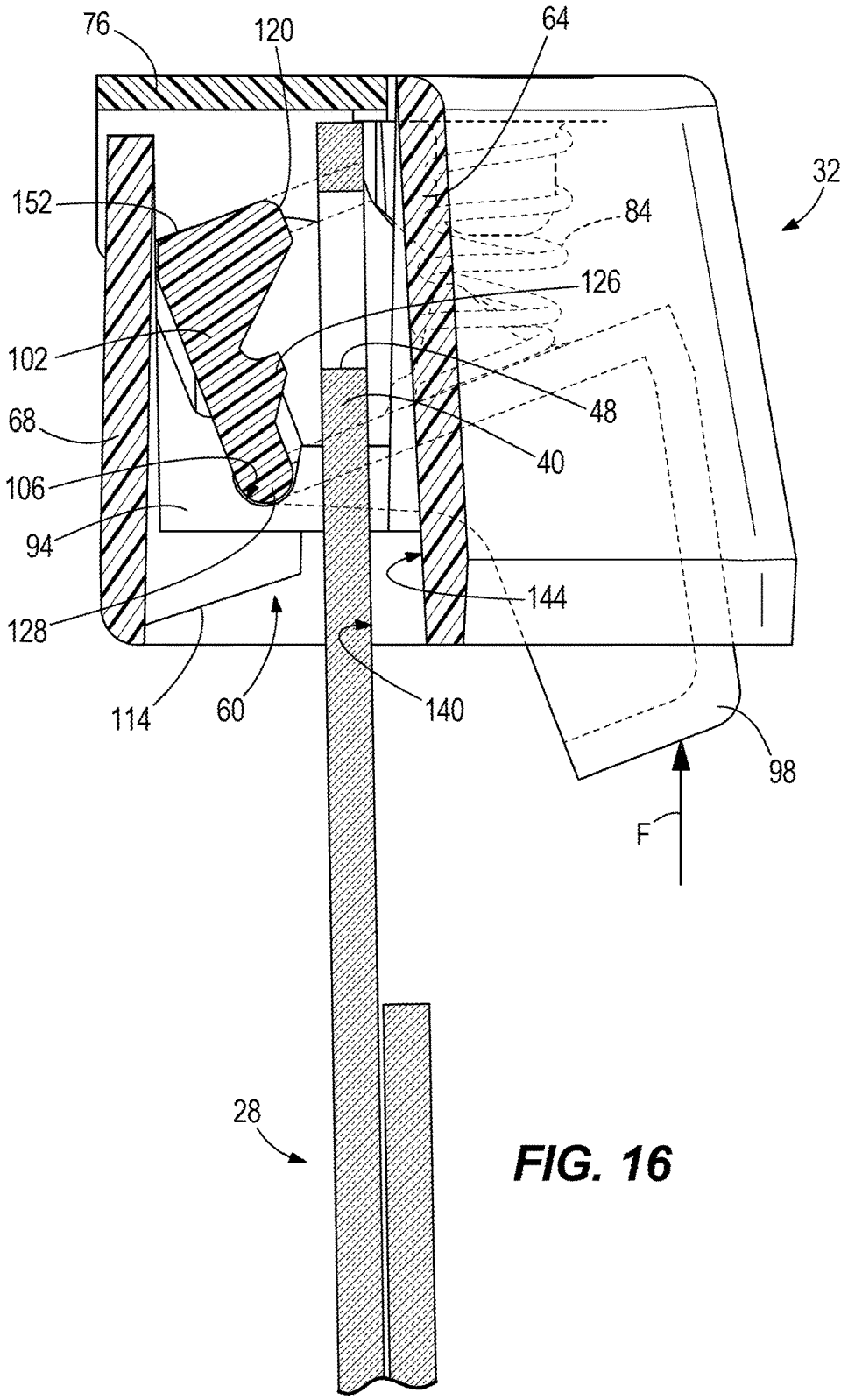
FIG. 16 is a cross-section taken at the same plane as FIG. 13, showing actuation of the button member by a force to allow free insertion or release of the sleeve from the sleeve holder.

FIGS. 13 and 14 illustrate the display card holder 20 in an assembled state where the sleeve 28 is fully inserted into the sleeve 32 holder and latched by the button member 80. Full insertion of the sleeve 28 can include inserting the end section 40 until it comes into contact with the closed end of the cavity 60 in some constructions, though the latched or fully seated position is defined by the position that enables the pins 120 to extend into a retaining engagement with the cutouts 48. In some constructions, the leading edge of the end section 40 (in the insertion direction) contacts a portion of the top wall of the sleeve holder 32 formed by the sleeve holder body 58, but is spaced from the cap 76, when fully inserted. The leading edge of the end section 40 can be provided by two spaced leading edge sections 160 (FIG. 7) that are adapted to contact two spaced top wall surface portions 164 (FIG. 8) that lie outside the wings 102 and the partial walls 110 on either side. FIG. 13 is a section taken through one of the pins 120 and the corresponding cutout 48. As shown, the pin 120 extends through the entire thickness T of the sleeve end section 40. The distal end of the pin 120 extends past the sleeve end section 40, and past the flat, co-planar surfaces 140 (FIG. 13) into the pocket 144 but not into contact therewith. Rather, as shown in FIGS. 13 and 14, the force from the spring 84 is directed through the button member 80 to the raised ridges 126 that exert the force onto the end section 40 to pinch the sleeve 28 against the pair of flat, co-planar surfaces 140. Because the sleeve-receiving channel provides the width T2 having clearance for the end section thickness T, the button member 80 urges the end section 40 to a position spaced away from the angled ramp surfaces 114. Furthermore, along the lengthwise direction L (FIG. 3) in which the end section 40 of the sleeve 28 is inserted into the sleeve holder 32, the raised ridges 126 contact and press upon the end section 40 at a position that is centrally located along an insertion depth D of the end section 40 into the sleeve holder 32. For example, the raised ridges 126 can contact the end section within a central third of the insertion depth D, or directly at the midpoint of the insertion depth D.

FIG. 15 is a cross-section along the same plane as FIG. 13, through one of the pins 120. FIG. 15 illustrates the sleeve holder 32 in its natural state, with the end section 40 just engaging the ramped inlet surfaces 130 leading up to the raised ridges 126. In the natural state of the sleeve holder 32, when the sleeve 28 is not held by the button member 80, the spring 84 can bias the button member 80 in the clockwise direction so that distal ends of the pins 120 abut the end surfaces of the respective pockets 144 in the sleeve holder body 58. In this position, the ramped inlet surfaces 130 lie within the path of the incoming sleeve 28, i.e., along the sleeve-receiving channel, as do the ramped inlet surfaces 122 of the pins 120. Lengthwise insertion of the sleeve end section 40 against the ramped inlet surfaces 130 and then the ramped inlet surfaces 122 can urge the button member 80 back against the bias force of the spring 84 to seat the end section 40 into the latched position of FIGS. 13 and 14. Alternately, the user can actuate the button member 80 prior to inserting the sleeve 28 by engaging and lifting the actuator portion 98 of the button member 80 with the force F as shown in FIG. 15, which operates to remove the button member 80 (i.e., any and all portions of the wings 102) from obstructing the sleeve-receiving channel. Thus, the sleeve end section 40 can be freely inserted without friction or obstruction all the way to the upper end of the cavity 60 to assume the fully seated position. Likewise, lifting the actuator portion 98 with the force F when the sleeve 28 is latched to the sleeve holder 32 causes unlatching and the removal of all pinching forces on the sleeve end section 40 such that the sleeve 28 is freely released from the sleeve holder 32 without any additional friction or obstruction to maintain the hold of the sleeve holder 32 on the sleeve 28. In simple terms, the sleeve 28 is free to drop out of the sleeve holder 32 when the button member 80 is actuated to the fully unlatched position of FIG. 16. In the fully unlatched position, which corresponds to the largest deflection of the spring 84, a portion of the button member 80 may contact the rear wall 68. For example, a portion of each wing 102 adjacent the upper edge 152 may contact the inside of the rear wall 68.

When the sleeve 28 is latched into the sleeve holder 32, loads may be applied to the sleeve 28 in a releasing direction from a variety of potential sources. For example, the sleeve 28 may be pulled on or impacted during use at times when a user is not actively operating the actuator portion 98 to unlatch the sleeve 28. In such circumstances, it is desirable to ensure that the sleeve 28 remains securely latched, and the display card holder 20 is robust to withstand such loads without breakage. In the illustrated construction, loads applied to the sleeve 28 while the sleeve 28 is coupled to the sleeve holder 32 are not carried by or transmitted through the actuator portion 98 of the button member 80 whatsoever. The actuator portion 98 extends freely from the open bottom end of the cavity 60 and does not abut with the front wall 64 in response to loads applied to the sleeve 28. Rather, loads from the sleeve 28 tending to pull the sleeve 28 out of the sleeve holder 32 are received by the pins 120 and transmitted through the wings 102 into the pivot cradles 106, 108. Loads received by the front and/or rear walls 64, 68 are thus received through the cradles 106, 108 secured thereto. Thus, loads from the sleeve 28 do not impart any forces tending to unseating or release the button member 80. In fact, such loads would only further urge the button member 80 to its seated position in the sleeve holder 32.

Although the detailed description of the illustrated embodiment highlights certain features and advantages of the invention, it is also noted that numerous variations are contemplated and envisioned, not all of which are illustrated or discussed in detail. However, certain adaptations that will be apparent to one of ordinary skill in the art upon review of this application are specifically mentioned for clarity. For example, the button member 80 may be adapted to pinch the sleeve end section 40 against the rear wall 68 rather than the front wall 64 as illustrated. It is also noted that the end section 40 need not be pinched by the button member 80 in all constructions. For example, the inventor envisions an embodiment in which the distal ends of the pins 120 contact the end surfaces of the respective pockets 144 when the sleeve end section 40 is fully inserted and latched by the pins 120, such that there is a small front-to-rear clearance (e.g., 0.1 mm to 1 mm) for the thickness T of the end section 40, between the button member 80 and the adjacent surfaces of the cavity 60. Such a construction may be achieved in one construction by removing the raised ridges 126 from the wings 102. However, it is also contemplated to pinch the end section 40 without raised ridges 126 on the wings 102. Finally, the end section 40 of the sleeve 28 that is inserted into and selectively latched by the sleeve holder 32 can include two overlying panels or plies.

Various features and advantages of the invention are set forth in the following claims.

What is claimed is:

1. A display card holder comprising:

a sleeve defining a receptacle for a printed card, wherein the sleeve includes an end section defining a thickness and having a pair of cutouts;

a sleeve holder defining a cavity open at one end to receive the end section of the sleeve, wherein the cavity defines a sleeve-receiving channel having a width providing clearance to the thickness of the sleeve;

a button member movably supported by a body of the sleeve holder, the button member defining an actuator portion that is exposed to an outside of the sleeve holder, wherein the button member further includes a pair of wings extending from opposite sides of the actuator button; and a spring arranged to bias the button member in a first direction with respect to the body of the sleeve holder, wherein each of the pair of wings is formed to include a pin adapted to extend through a corresponding one of the pair of cutouts, and an elongate first edge forming a pivot about which the button member is pivotable with respect to the body of the sleeve holder.

2. The display card holder of claim 1, wherein the sleeve holder includes a cap member secured to the body of the sleeve holder to retain the button member therein.

3. The display card holder of claim 2, wherein each of the pair of wings of the button member further includes a second edge opposite the first edge, and wherein the cap member includes an arcuate guide surface adjacent to and in sliding relationship with each second edge.

4. The display card holder of claim 1, wherein the open end of the cavity is subdivided into three sections by two cross-bars, each of the cross-bars extending between a front wall and a rear wall of the cavity.

5. The display card holder of claim 4, wherein the two cross-bars form a cradle receiving the elongate first edges of respective ones of the pair of wings to form the pivot.

6. The display card holder of claim 5, wherein the holder further includes two distal supports extending from the rear wall and forming additional cradles receiving distal ends of the elongate first edges of respective ones of the pair of wings.

7. The display card holder of claim 1, wherein biasing of the button member in the first direction with the spring pinches the sleeve against two flat, co-planar cavity surfaces formed by a wall of the sleeve holder.

8. The display card holder of claim 7, wherein the wall of the sleeve holder is recessed to form a pocket at the location of each pin, each pocket allowing the corresponding pin to extend past the two flat, co-planar cavity surfaces.

9. The display card holder of claim 1, wherein the sleeve is inserted lengthwise into the sleeve-receiving channel to a fully seated position in which the pins are extendable through the cutouts in the end section, in the fully seated position, the end section defines a lengthwise insertion depth that is received by the sleeve holder, and in the fully seated position, a raised ridge of each of the pair of wings establishes a line of contact with the end section positioned within a central third of the insertion depth.

10. The display card holder of claim 1, wherein each of the pair of wings is formed to include an angled lead-in ramp surface extending from the elongate first edge, and wherein each pin further includes an angled lead-in ramp surface on a side facing the elongate first edge, such that the button member is adapted for deflection by insertion of the end section of the sleeve to enable engagement of the pins into the pair of cutouts without separately pressing the actuator portion.

11. A display card holder comprising:

a sleeve defining a receptacle for a printed card, wherein the sleeve includes an end section defining a thickness and having at least one cutout;

a sleeve holder defining a cavity open at one end to receive the end section of the sleeve, wherein the cavity defines a sleeve-receiving channel having a width providing clearance to the thickness of the sleeve;

a button member movably supported by a body of the sleeve holder and defining an actuator portion, wherein the button member is pivotably supported in a cradle of the sleeve holder and adapted to latch into the at least one cutout of the sleeve end section; and a spring arranged to bias the button member in a first direction with respect to the body of the sleeve holder so that the end section of the sleeve is pinched by the button member against an interior surface of the cavity when fully inserted into the sleeve-receiving channel;

wherein the sleeve holder includes a cap member secured at an end of the sleeve holder opposite the open end to enclose the button member and form an arcuate guide surface establishing a sliding interface with the button member.

12. The display card holder of claim 11, wherein the button member includes a raised ridge arranged for pressing upon the sleeve when inserted into the cavity.

13. The display card holder of claim 12, wherein the raised ridge establishes a line of contact with the end section at a position of the end section that is centrally located in a lengthwise direction in which the sleeve is inserted into the sleeve holder.

14. The display card holder of claim 11, wherein the cradle of the sleeve holder is formed by a plurality of cross-bars spanning between a front wall of the sleeve holder and a rear wall of the sleeve holder.

15. The display card holder of claim 14, wherein the actuator portion extends from the open end of the sleeve holder, and wherein a front surface of the button member actuator portion becomes increasingly hidden behind the front wall when the button member is actuated against the bias of the spring.

16. The display card holder of claim 14, wherein the cap member defines a wall extending perpendicular to the front and rear walls, and wherein the spring is compressed between the button member and the wall of the cap member.

17. The display card holder of claim 14, wherein the plurality of cross-bars includes a first pair of cross-bars flanking opposite ends of the actuator portion of the button member and a second pair of cross-bars positioned at opposite distal ends of a pair of wings that extend outward from the ends of the actuator portion.

18. The display card holder of claim 17, wherein the at least one cutout of the sleeve end section includes a pair of cutouts, and wherein each of the pair of wings of the button member includes a pin adapted to latch into a respective one of the pair of cutouts.

19. The display card holder of claim 11, wherein the sleeve is pinched by the button member against a pair of flat, co-planar interior cavity surfaces formed by a wall of the sleeve holder when fully inserted into the sleeve-receiving channel.

20. The display card holder of claim 19, wherein the button member includes a pair of pins biased by the spring toward the wall of the sleeve holder, and the wall is recessed to form a pocket at the location of each pin, each pocket allowing the corresponding pin to extend past the pair of flat, co-planar cavity surfaces.

* * * * *